US010876060B2

(12) United States Patent
Eastin et al.

(10) Patent No.: US 10,876,060 B2
(45) Date of Patent: Dec. 29, 2020

(54) DROPLET FOR FUELS

(71) Applicant: Kamterter Products, LLC, Waverly, NE (US)

(72) Inventors: John Alvin Eastin, Waverly, NE (US); David Vu, Waverly, NE (US)

(73) Assignee: Kamterter Products, LLC, Waverly, NE (US)

( * ) Notice: Subject to any disclaimer, the term of this patent is extended or adjusted under 35 U.S.C. 154(b) by 86 days.

(21) Appl. No.: 15/821,066

(22) Filed: Nov. 22, 2017

(65) Prior Publication Data

US 2018/0251693 A1 Sep. 6, 2018

Related U.S. Application Data

(60) Provisional application No. 62/427,694, filed on Nov. 29, 2016.

(51) Int. Cl.

| | |
|---|---|
| ***C10L 1/32*** | (2006.01) |
| ***C10L 1/00*** | (2006.01) |
| ***C10L 1/08*** | (2006.01) |

(52) U.S. Cl.

CPC ..... *C10L 1/32* (2013.01); *C10L 1/00* (2013.01); *C10L 1/08* (2013.01); *C10L 1/322* (2013.01); *C10L 1/324* (2013.01); *C10L 2250/04* (2013.01); *C10L 2250/06* (2013.01)

(58) Field of Classification Search

CPC combination set(s) only.

See application file for complete search history.

(56) References Cited

U.S. PATENT DOCUMENTS

| | | | | |
|---|---|---|---|---|
| 5,849,310 | A * | 12/1998 | Trinh | A61K 8/02 424/401 |
| 6,528,070 | B1 | 3/2003 | Bratescu et al. | |
| 2003/0228763 | A1 | 12/2003 | Schroeder et al. | |
| 2007/0213412 | A1 * | 9/2007 | Bacon | A61F 13/51 516/53 |
| 2019/0380973 | A1 * | 12/2019 | Yang | A61K 31/422 |

OTHER PUBLICATIONS

International Search Report and Written Opinion dated Mar. 19, 2018 for PCT/US2017/063111.

Kerosene, Jun. 1999 (retrieved on Feb. 20, 2018). Retrieved from Internet: https:/cameochemicals.noaa.gov/chris/KRS.pdf, 2 pages.

* cited by examiner

*Primary Examiner* — Ellen M McAvoy
*Assistant Examiner* — Chantel L Graham
(74) *Attorney, Agent, or Firm* — Suiter Swantz pc llo

(57) ABSTRACT

A droplet formation for fuels is disclosed. The droplet formation for fuels includes an amphiphile. The droplet formation for fuels further includes at least one of an extensional viscosity modifier and a viscosity modifier. The droplet formation for fuels further includes a hydrophilic portion. The droplet formation for fuels further includes a hydrophobic portion. The droplet, including the hydrophilic portion and the hydrophobic portion, includes characteristics selected for beneficial combustion properties. The selected characteristics include flash point, autoignition temperature, density, viscosity, miscibility, size, combustion temperature, organic properties, inorganic properties, zwitterionic properties, micelle properties, and particulate properties.

21 Claims, 9 Drawing Sheets

DROPLET FOR FUELS

The present application is related to and claims the benefit of the earliest available effective filing date(s) from the following listed application(s) (the "Related Applications") (e.g., claims earliest available priority dates for other than provisional patent applications or claims benefits under 35 USC § 119(e) for provisional patent applications, for any and all parent, grandparent, great-grandparent, etc. applications of the Related Application(s)). All subject matter of the Related Applications and of any and all parent, grandparent, great-grandparent, etc. applications of the Related Applications is incorporated herein by reference in its entirety or to the extent such subject matter is not inconsistent herewith.

RELATED APPLICATIONS

The present application is related to U.S. Patent No. 62/427,694, entitled DROPLET FOR FUELS, naming John Alvin Eastin and David Vu as inventors, filed Nov. 29, 2016.

TECHNICAL FIELD

The present invention generally relates to fuel technology, and, in particular, a droplet for fuels.

BACKGROUND

A water-in-oil type fuel (e.g., water in diesel emulsion) has gained popularity over the last decade due to a reduction of toxic gases (e.g., nitrogen oxide gases, carbon dioxide, or carbon monoxide) and soot emission produced from combustion engines and an improved efficiency of the combustion engines. The water-in-oil type fuel promotes more efficient fuel burning in the combustion engines due to the ability to break up the fuel into smaller droplets when vaporized, which increases surface area of the water-in-oil type fuel compared to the conventional fuels alone. In response to the increased surface area of the water-in-oil type fuel, the water-in-oil type fuel burns cleanly so as not to leave the residual unburned fuel in the combustion engines. Additionally, the water-in-oil type fuel decreases a temperature in a chamber of the combustion engines, which results in decreased generation of toxic gases. However, this is mainly limited to conventional fuels (e.g., petroleum based fuels) due to a viscosity constraint. Fuels with high viscosity mix poorly with water and further lead to a clog in the injector outlet orifice.

Boilers, refinery and chemical fluid heaters, rotary kilns, glass melters, solids dryers, drying ovens, organic fume incinerators, or other combustion devices that use combustion reactions or processes often include more than one type of burner or a burner that is capable of using only a single type of fuel. For example, a first burner type may be a burner that utilizes a more expensive fuel, or a fuel with a higher energy density (e.g., MJ/kg), such as methane. A second burner type may utilize a cheaper fuel, or a fuel with a lower energy density, such as coal. Uses of the different types of burners may include, but are not limited to, a pre-heat burner and a primary combustion burner. Often these different types of burners are limited to a single, specific type of fuel (e.g., methane or coal, not both).

Therefore, it would be desirable to provide a system that cures the deficiencies of prior approaches.

SUMMARY

A droplet formation for fuels is disclosed, in accordance with one or more embodiments of the present disclosure. In embodiments, the droplet formation for fuels includes an amphiphile. In some embodiments, the droplet formation for fuels further includes at least one of an extensional viscosity modifier and a viscosity modifier. In some embodiments, the droplet formation for fuels further includes a hydrophilic portion. In some embodiments, the droplet formation for fuels further includes a hydrophobic portion.

The foregoing is a summary and thus may contain simplifications, generalizations, inclusions, and/or omissions of detail; consequently, those skilled in the art will appreciate that the summary is illustrative only and is not intended to be in any way limiting. Other aspects, features, and advantages of the systems, products and/or methods and/or other subject matter described herein will become apparent in the teachings set forth herein. The accompanying drawings, which are incorporated in and constitute a part of the specification, illustrate embodiments of the disclosure and together with the general description, serve to explain the principles of the invention.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION OF THE INVENTION

Reference will now be made in detail to the subject matter disclosed, which is illustrated in the accompanying drawings.

Referring generally to FIGS. 1A-6, the present disclosure is generally directed to a droplet formation for fuels. Further, embodiments of the present disclosure are directed to various droplet formations for fuels improving physical properties toward combustion engines, boilers, refinery and chemical fluid heaters, rotary kilns, glass melters, solids dryers, drying ovens, organic fume incinerators, or other combustion devices. Embodiments of the present disclosure further achieve a droplet formation with highly viscous fluids and an enclosure of gas and solid components within the droplet to improve the droplet combustion property.

As used throughout the present disclosure, the terms "hydrophilic" or "hydrophile" are generally defined as a molecule or other molecular entity that is attracted to water molecules and tends to be dissolved by water.

As used throughout the present disclosure, the terms "hydrophobic" or "hydrophobe" are generally defined as a molecule or other molecular entity that is not attracted to water molecules.

As used throughout the present disclosure, the term "colloid" is generally defined as a substance that consists of particles dispersed throughout another substance which are too small for resolution with an ordinary light microscope but are incapable of passing through a semipermeable membrane.

As used throughout the present disclosure, the terms "micelle" or "micella" are generally defined as an aggregate (i.e., supramolecular assembly) of surfactant molecules dispersed in a liquid colloid.

As used throughout the present disclosure, the term "critical micelle concentration (CMC)" is generally defined as the concentration of surfactants above which micelles form and all additional surfactants added to the composition go to micelles.

As used throughout the present disclosure, the term "zwitterion" is generally defined as a molecule with both positive and negative electric charges. In some embodiments, the term "zwitterion" encompasses a neutral molecule.

As used throughout the present disclosure, the term "amphiphile" is generally defined as a molecule with both hydrophilic and hydrophobic properties.

As used throughout the present disclosure, the term "surfactant" is generally defined as a compound that lowers the surface tension between two liquids or between a liquid and a solid.

As used throughout the present disclosure, the term "combustion engine" is generally defined as an engine used for automobiles, motorcycles, ships, locomotives, aircrafts, gas turbines, or boilers.

Figure 1A:
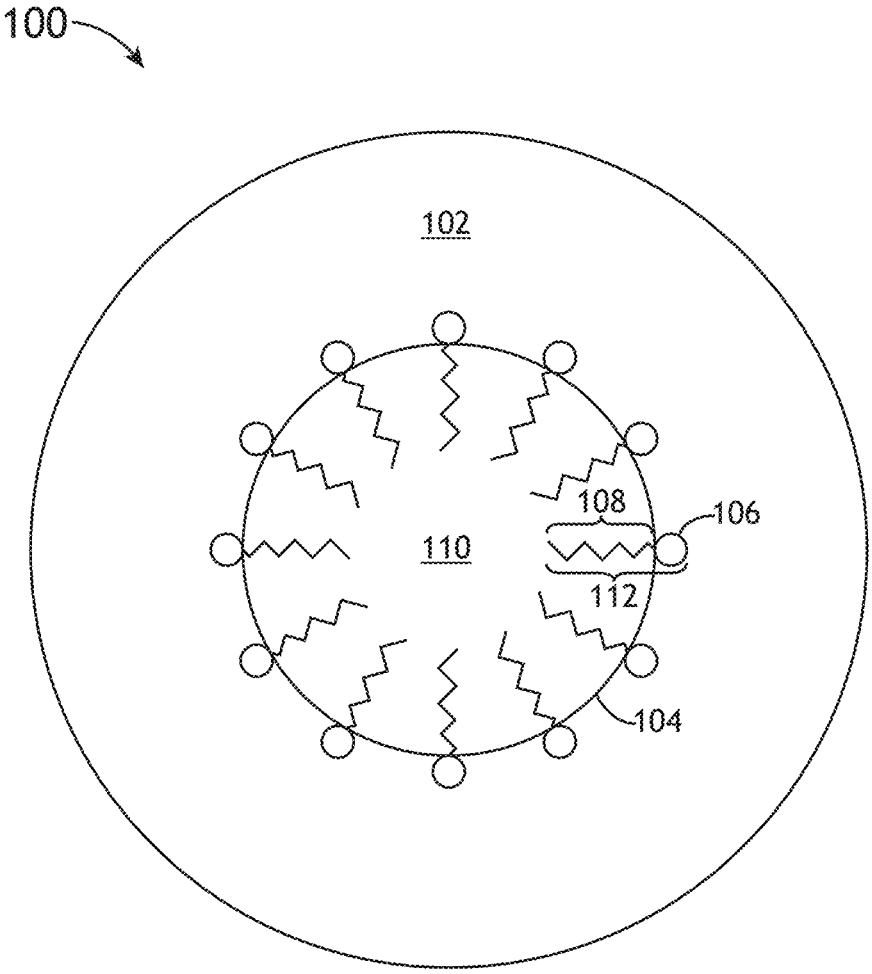
FIG. 1A illustrates a plan view of a droplet including a micelle, in accordance with one or more embodiments of the present disclosure.
Figure 1B:
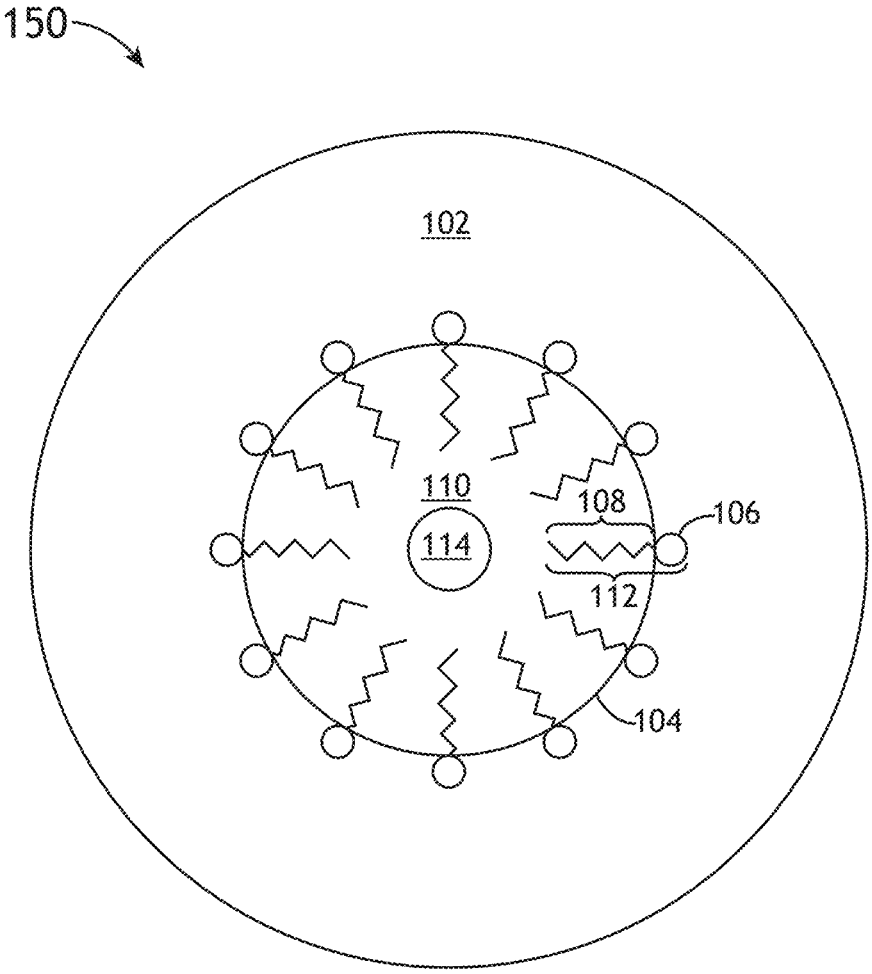
FIG. 1B illustrates a plan view of a droplet including a micelle with an internal component, in accordance with one or more embodiments of the present disclosure.

FIGS. 1A and 1B illustrate a droplet including micelle structure for fuels, in accordance with one or more embodiments of the present disclosure.

Referring now to FIG. 1A, in embodiments, a droplet 100 includes a hydrophilic portion 102 (i.e., a polar portion or a lipophobic portion) forming the most outer layer of the droplet 100 structure by surrounding hydrophobic portion 110 (i.e., a non-polar portion or a lipophilic portion) inside. For example, the hydrophilic portion 102 of the droplet 100 may be miscible with water. In this regard, the hydrophilic portion 102 of the droplet 100 miscible with water may be equipped with one or more hydroxyl groups, according to the following:

R—OH where the R group may be any element or compound that when combined with the hydroxyl functional group results a molecule that is miscible in water. For instance, the hydrophilic portion 102 miscible with water with one or more hydroxyl groups may include, but is not limited to, water, ethanol, methanol, 1-propanol, 2-propanol, t-butanol, glycerol, 1,2-butanediol, 1,3-butandiol, 1,4-butandiol, 2-butoxyethanol, ethylene glycol, furfuryl alcohol, 1,2-propanediol, 1,3-propanediol, triethylene glycol, or mixture thereof.

In some embodiments, the hydrophilic portion 102 of the droplet 100 equipped with one or more hydroxyl groups may have a flash point from a selected range. For example, the hydrophilic portion 102 of the droplet 100 may have a flash point in the range of 5° C. to 200° C. For instance, the hydrophilic portion 102 of the droplet 100 may have a flash point in the range of 11° C. to 160° C.

In some embodiments, the hydrophilic portion 102 of the droplet 100 equipped with one or more hydroxyl groups may have an autoignition temperature from a selected range. For example, the hydrophilic portion 102 of the droplet 100 may have an autoignition temperature in the range of 200° C. to 600° C. For instance, the hydrophilic portion 102 of the droplet 100 may have an autoignition temperature in the range of 245° C. to 480° C.

In some embodiments, the hydrophilic portion 102 of the droplet 100 equipped with one or more hydroxyl groups may have a density from a selected range. For example, the hydrophilic portion 102 of the droplet 100 may have a density in the range of 0.5 kg/l to 2.0 kg/l at 20° C. For instance, the hydrophilic portion 102 of the droplet 100 may have a density in the range of 0.775 kg/l to 1.26 kg/l at 20° C.

In some embodiments, the hydrophilic portion 102 of the droplet 100 equipped with one or more hydroxyl groups may have a viscosity from a selected range. For example, the hydrophilic portion 102 of the droplet 100 may have a viscosity in the range of 0.042 centipoise to 1475 centipoise at 20° C.

In some embodiments, the hydrophilic portion 102 of the droplet 100 may be equipped with one or more aldehyde groups. For example, portion 102 of the droplet 100 may include a molecule according to the following:

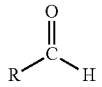

where the R group may be any element or compound that when combined with the aldehyde functional group results a molecule having hydrophilic properties. For instance, the hydrophilic portion 102 may be equipped with one or more aldehyde groups including, but not limited to, acetaldehyde.

In some embodiments, the hydrophilic portion 102 of the droplet 100 may be equipped with one or more carboxylic acid groups. For example, portion 102 of the droplet 100 may include a molecule according to the following:

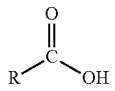

where the R group may be any element or compound that when combined with the carboxylic acid functional group results a molecule having hydrophilic properties. For instance, the hydrophilic portion 102 may include, but not limited to, acetic acid, butyric acid formic acid, propanoic acid, or mixture thereof.

In some embodiments, the hydrophilic portion 102 of the droplet 100 may be equipped with one or more ketone groups. For example, portion 102 of the droplet 100 may include a molecule according to the following:

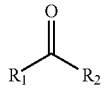

where the $R_1$ and $R_2$ group may be any element or compound that when combined with the ketone functional group results a molecule having hydrophilic properties. For instance, the hydrophilic portion 102 may include, but not limited to, acetone.

In some embodiments, the hydrophilic portion 102 of the droplet 100 may be equipped with one or more amine groups. For example, portion 102 of the droplet 100 may include a molecule according to the following:

$$R_1—N(R_2)_2$$

where the $R_1$ and $R_2$ group may be any element or compound that when combined with the amine functional group results a molecule having hydrophilic properties. For instance, the hydrophilic portion 102 may include, but not limited to, diethanolamine, diethylenetriamine, dimethylformamide, ethylamine, methyl diethanolamine, triethylamine or mixture thereof.

In some embodiments, the hydrophilic portion 102 of the droplet 100 may be equipped with one or more ether groups. For example, portion 102 of the droplet 100 may include a molecule according to the following:

$$R_1—O—R_2$$

where the $R_1$ and $R_2$ group may be any element or compound that when combined with the ether functional group results a molecule having hydrophilic properties. For instance, the hydrophilic portion 102 may be equipped with one or more ether groups including, but not limited to, 1,4-dioxane, tetrahydrofuran, or mixture thereof.

In some embodiments, the hydrophilic portion 102 of the droplet 100 may be equipped with one or more nitrile groups. For example, portion 102 of the droplet 100 may include a molecule according to the following:

$$R—CN$$

where the R group may be any element or compound that when combined with the nitrile functional group results a molecule having hydrophilic properties. For instance, the hydrophilic portion 102 may be equipped with one or more nitrile groups including, but not limited to, acetonitrile.

In some embodiments, the hydrophilic portion 102 of the droplet 100 may be an inorganic compound. For example, the inorganic hydrophilic portion may include, but is not limited to, hydrazine, hydrazine derivatives, hydrofluoric acid, hydrogen peroxide, nitric acid, sulfuric acid, or mixture thereof. For instance, hydrazine derivatives may include, but is not limited to, 1,2-dimethylhydrazine.

It is noted that, while the hydrophilic portion 102 shown in FIG. 1A is depicted as a droplet composition with one hydrophilic portion, such a configuration is merely provided for illustrative purposes. The present disclosure may be configured to adapt more than one hydrophilic portions to provide necessary physical properties to the composition of droplet 100.

In embodiments, the droplet 100 includes a hydrophobic portion 110 (i.e., a non-polar portion or a lipophilic portion) enclosed by the hydrophilic portion 102 and separated by a layer 104. For example, the hydrophobic portion 110 may include a hydrocarbon chain in a molecular structure of the hydrophobic portion 110. For instance, the hydrocarbon chain of the hydrophobic portion 110 may include, but not limited to, a linear hydrocarbon chain or a branched hydrocarbon chain.

Further, the hydrophobic portion 110 equipped with the linear or branched hydrocarbons may include, but are not limited to, conventional fuels, alternative fuels, or mixture thereof. For example, the conventional fuels may include, but are not limited to, gasolines, diesel fuels, kerosene, dimethyl ether, jet fuel, or mixtures thereof. By way of another example, the alternative fuels may include, but are not limited to, biodiesels, or vegetable oils. For instance, the vegetable oils which can be used for alternative fuels may include, but are not limited to, corn oil, canola oil, soybean oil, olive oil, sunflower oil, rapeseed oil, peanut oil or mixtures thereof.

In some embodiments, the hydrophobic portion 110 of the droplet 100 may have a flash point from a selected range. For example, the hydrophobic portion 110 of the droplet 100 may have a flash point in the range of −100° C. to 100° C. For instance, the hydrophobic portion 110 of the droplet 100 may have a flash point in the range of −43° C. to 72° C. By way of another example, the hydrophobic portion 110 of the droplet 100 may have a flash point from a second selected range. For example, the hydrophobic portion 110 of the droplet 100 may have a flash point in the range of 50° C. to 400° C. For instance, the hydrophobic portion 110 of the droplet 100 may have a flash point in the range of 100° C. to 327° C.

In some embodiments, the hydrophobic portion 110 of the droplet 100 may have an autoignition temperature from a selected range. For example, the hydrophobic portion 110 of the droplet 100 may have an autoignition temperature in the range of 150° C. to 450° C. For instance, the hydrophobic portion 110 of the droplet 100 may have an autoignition temperature in the range of 210° C. to 350° C. By way of another example, the hydrophobic portion 110 of the droplet 100 may have an autoignition temperature from a second selected range. For example, the hydrophobic portion 110 of the droplet 100 may have an autoignition temperature in the range of 150° C. to 500° C. For instance, the hydrophobic portion 110 of the droplet 100 may have an autoignition temperature in the range of 177° C. to 470° C.

In some embodiments, the hydrophobic portion 110 of the droplet 100 may have a density from a selected range. For example, the hydrophobic portion 110 of the droplet 100 may have a density in the range of 0.5 kg/l to 1.0 kg/l at 20° C. For instance, the hydrophobic portion 110 of the droplet 100 may have a density in the range of 0.72 kg/l to 0.89 kg/l at 20° C. By way of another example, the hydrophobic portion 110 of the droplet 100 may have a second density from a selected range. For example, the hydrophobic portion 110 of the droplet 100 may have a density in the range of 0.5 kg/l to 1.0 kg/l at 20° C. For instance, the hydrophobic portion 110 of the droplet 100 may have a density in the range of 0.79 kg/l to 0.92 kg/l at 20° C.

In some embodiments, the hydrophobic portion 110 of the droplet 100 may have a viscosity from a selected range. For example, the hydrophobic portion 110 of the droplet 100 may have a viscosity in the range of 0.4 centipoise to 12 centipoises at 20° C. By way of another example, the hydrophobic portion 110 of the droplet 100 may have a viscosity from a second selected range. For example, the hydrophobic portion 110 of the droplet 100 may have a viscosity in the range of 1.0 centipoise to 100 centipoises at 20° C. For instance, the hydrophobic portion 110 of the droplet 100 may have a viscosity in the range of 4.0 centipoise to 84 centipoises at 20° C.

It is noted that, while the hydrophobic portion 110 shown in FIG. 1A is depicted as a droplet composition within one hydrophilic portion, such a configuration is merely provided for illustrative purposes. The present disclosure may be configured to adapt more than one hydrophobic portions to provide necessary physical properties to the composition of droplet 100. It is further noted that, while the droplet 100 shown in FIG. 1A is depicted to have approximately the same amount of the hydrophobic portion 110 and the hydrophilic portion 102, such a configuration is merely provided for illustrative purposes. The present disclosure may be configured to have various ratios of the hydrophobic portion 110 and the hydrophilic portion 102 to form the droplet 100. In general, in order to form normal micelles (i.e., an oil-in-water system) such as the droplet 100 shown in FIG. 1A, a ratio of the hydrophilic portion 102 to the hydrophobic portion 110 needs to be greater than 1 to 1.

In some embodiments, a volume of the hydrophilic portion 102 of the droplet 100 to hydrophobic portion 110 of the droplet 100 may have a selected ratio. For example, the ratio of the hydrophilic portion 102 to the hydrophobic portion 110 may be between 1 to 1 and 4 to 1 by volume. For instance, the ratio of the hydrophilic portion 102 to the hydrophobic portion 110 may be between 2 to 1 and 3 to 1.

In embodiments, a droplet 100 includes an amphiphile 112 (i.e., amphiphiles) defining a layer 104 between the hydrophilic portion 102 and the hydrophobic portion 110 of the amphiphile 112. For example, the amphiphile 112 may include lipophilic (i.e., non-polar), charged hydrophilic (i.e., polar cationic or anionic), or uncharged hydrophilic (i.e., polar nonionic or polar uncharged) properties. For instance, the amphiphile 112 may include a polar uncharged functional group, including but not limited to, a hydroxy group (e.g., alcohols or water), an amine group (e.g., amines), and/or a carbonyl group (e.g., aldehydes, ketones, amides, carboxylic acids, esters, acyl halides, enones, imides, or etc.).

The amphiphile 112 may include a hydrophilic head 106 facing toward the hydrophilic portion 102 and a hydrophobic tail 108 interacting with the hydrophobic portion 110 of the droplet 100. The hydrophilic head 106 of the amphiphile 112 may be in contact with the surrounding hydrophilic portion 102. The hydrophilic head 106 of the amphiphile 112 may be nonionic, cationic, anionic, or zwitterionic. For instance, the nonionic hydrophilic head 106 of the amphiphile 112 may include, but are not limited to, octaethylene glycol monododecyl ether, pentaethylene glycol monododecyl ether, decyl glucoside, lauryl glucoside, octyl glucoside, triton X-100, nonoxynol-9, glyceryl laurate, polysorbate, cocamide monoethanolamine, cocamide diethanolamine, dodecyldimethylamine oxide, poloxamers, n-decyl b-D-glucopyranoside, polyoxyethylene dodecanol (i.e., BRIJ 35), polyoxyethylene sorbitane monooleate (i.e., tween 80), sorbitan sesquioleate, polyoxyethylene sorbitabe monolaurate (i.e., tween 20), polyoxyethylene dinonylphenyl ether, octyl phenoxy polyethoxyethanol, phospholipids, cholesterol, glycolipid, fatty acid, saponin, fatty alcohols, cetyl alcohol, stearyl alcohol, cetostearyl alcohol, oleyl alcohol, or polyethoxylated tallow amine. In this regard, the nonionic hydrophilic head 106 of the amphiphile 112 are equipped with long hydrocarbon chain alcohols (i.e., one or more uncharged hydroxy groups).

In some embodiments, the cationic hydrophilic head 106 of the amphiphile 112 may include, but are not limited to, octenidine dihydrochloride, cetrimonium bromide, cetylpyridinium chloride, benzalkonium chloride, benzethonium chloride, dimethyldioctadecylammonium chloride, dioctadecyldimethylammonium bromide, cetyltrimethylammonium chloride, cetyltrimethylammonium bromide, dodecyltrimethylammonium bromide, or hexadecyltrimethylammonium bromide.

In some embodiments, the cationic hydrophilic head 106 of the amphiphile 112 is selected from cationic functional groups with specific properties. For example, the cationic hydrophilic head 106 may be selected from compounds having amines or ammonium salts.

In some embodiments, the anionic hydrophilic head 106 of the amphiphile 112 may include, but are not limited to, ammonium laurylsulfate, sodium lauryl sulfate, sodium laureth sulfate, sodium myreth sulfate, dioctyl sodium sulfosuccinate, perfluorooctanesulfonate, perfluorobutanesulfonate, sodium cholic acid, sodium deoxycholic acid, sodium glycocholic acid, sodium taurocholic acid, or sodium tetradecyl sulfate.

In some embodiments, the anionic hydrophilic head 106 of the amphiphile 112 is selected from anionic functional groups with specific properties. For example, the anionic hydrophilic head 106 may be selected from compounds having anionic functional groups including sulfate, sulfonate, phosphate, or carboxylates.

In some embodiments, the zwitterionic hydrophilic head 106 of the amphiphile 112 may include, but are not limited to, 3-[(3-cholamidopropyl)dimethylammonio]-1-propanesulfonate (i.e., CHAPS), 3-[(3-cholamidopropyl)dimethylammonio]-2-hydroxy-1-propanesulfonate (i.e., CHAPSO), N-dodecyl-N,N-dimethylammonio-3-propane sulfonate, cocamidopropyl hydroxysultaine (i.e., CAHS), cocamidopropyl betaine, phospholipids phosphatidylserine, phosphatidylethanolamine, phosphatidylcholine, sodium dodecyl sulfate, amino acids, amine oxides, or sphingomyelins.

In some embodiments, the zwitterionic hydrophilic head 106 of the amphiphile 112 is selected from zwitterionic compounds with specific properties. For example, the zwitterionic hydrophilic head 106 may be selected from compounds having an amine or ammonium cation as a cationic center of the zwitterionic hydrophilic head 106 and sulfonates, carboxylates, or phosphates as an anionic center of the zwitterionic hydrophilic head 106.

Further, the hydrophobic tail 108 of the amphiphile 112 may be formed essentially from hydrocarbons. For example, the hydrocarbons of the hydrophobic tail 108 may be linear hydrocarbons. By way of another example, the hydrocarbons of the hydrophobic tail 108 may be branched hydrocarbons. By way of yet another example, the hydrocarbons of the hydrophobic tail 108 may be cyclic hydrocarbons. For instance, the cyclic hydrocarbons of the hydrophobic tail 108 may be aromatic hydrocarbons. It is noted that embodiments of the present disclosure may be configured to include various types of the hydrophobic tail 108 in the droplet 100 including, but not limited to, combinations of linear and branched hydrocarbons, linear and cyclic hydrocarbons, or branched and cyclic hydrocarbons. It is further noted that the hydrocarbons of the hydrophobic tail 108 may be fully saturated hydrocarbons, partially saturated hydrocarbons, or unsaturated hydrocarbons.

It is contemplated that, while the hydrophobic tail 108 depicted in FIG. 1A represents a linear hydrocarbon chain, such a configuration is merely provided for illustrative purposes. The present disclosure may be configured to include the hydrophobic tail 108 with a branched hydrocarbon chain, cyclic hydrocarbon chain, or combination thereof.

In embodiments, the droplet 100 includes a surfactant. The surfactant may adjust surface tension of a fluid surrounding a particle (e.g., coal dust). The surfactant may adjust an oxygen concentration at a surface of the particle. The surfactant may include a penetrant. For example, the surfactant may include but is not limited to a secondary alcohol ethoxylate, a phospholipid, an organosilicone, an organosulfur compound (e.g., dimethyl sulfoxide), or combinations thereof.

In embodiments, a combined viscosity of the droplet 100 may have a selected range. For example, the droplet 100 may have a combined viscosity in the range of 0.2 centipoise to 2000 centipoise at 20° C. For instance, the droplet 100 may have a combined viscosity in the range of 0.4 centipoise to 1500 centipoise at 20° C. In some embodiments, the droplet 100 may have a combined viscosity of greater than or equal to 180 centipoise.

In embodiments, a combined density of the droplet 100 may have a selected range. For example, the droplet 100 may have a combined density in the range of 0.5 to 1.0 kg/l at 20° C. For instance, the droplet 100 may have a combined density in the range of 0.72 to 0.92 kg/l at 20° C.

In embodiments, a combined vapor pressure of the droplet 100 may depend on the components of the droplet, a temperature at which the vapor pressure is determined (e.g., process temperature), and a point at which the vapor pressure is determined (e.g., at formation or just prior to combustion). In embodiments, the vapor pressure may be calculated using an equation (e.g., Antoine Equation) or estimated using one or more diagrams (e.g., a p-T phase diagram, a reference substance plot, a Cox chart). For example, the droplet 200 may have as an exterior portion, the hydrophobic portion 210. If the hydrophobic portion 210 includes a fuel (e.g., $C_{12}H_{24}$, 1-dodecane), then a vapor pressure may be approximately from 0.0637 to 1.039 bar (0.0629 to 1.025 atm) at 126° C. to 218° C. By way of another example, the droplet 100 may have as an exterior portion, the hydrophilic portion 102. If the hydrophilic portion 102 includes water, then a vapor pressure may be approximately from 0.0128 to 7.52 bar (0.0126 to 7.43 atm) at 10° C. to 168° C. In some embodiments, the vapor pressure of the droplet (e.g., droplet 100 or droplet 200) may be from a first selected range. For example, the vapor pressure may be from 0.01 to 8 atm at 10° C. to 170° C. In some embodiments, the vapor pressure of the droplet (e.g., droplet 100 or droplet 200) may be from a second selected range. For example, the vapor pressure may be from 1.9 to 7.5 atm at 56° C. to 168° C.

It is noted that a micelle in the droplet 100 form only when a concentration of the amphiphile 112 is greater than the critical micelle concentration (CMC) and a temperature of the system is greater than the critical micelle temperature (i.e., Krafft temperature). It is further noted that the CMC of the droplet 100 may depend on a type of the amphiphile 112. For example, the CMC of the droplet 100 may be from 45 to 60 ppm at 25° C. when the droplet contains a secondary alcohol ethoxylate (e.g., Tergitol™) non-ionic surfactant.

In embodiments, the droplet 100 may be configured to have a selected range of droplet sizes as combustion fuels. For example, the droplet 100 may have a droplet size in the range of 10 μm to 400 μm for automotive engines and jet engines. For instance, the droplet 100 may have a droplet size in the range of 25 μm to 250 μm for automotive engines and jet engines. Further, the droplet 100 may have a droplet size in the range of 10 μm to 800 μm for gas turbines. For instance, the droplet 100 may have a droplet size in the range of 20 μm to 500 μm for gas turbines.

It is noted that the shape and size of the micelle in the droplet 100 are a function of the molecular geometry of the amphiphile 112 and portion conditions such as, but not limited to, temperature, pH, and ionic strength between the molecules. The average sizes of micelles in the droplet may range from 2 nm to 20 nm depending on compositions and concentrations.

It is contemplated that, while the droplet 100 shown in FIG. 1A is a spherical in shape, such a configuration is merely provided for illustrative purposes. The present disclosure may be configured to adapt other micelle shapes including, but not limited to, ellipsoids, cylinders, and bilayers. It is further contemplated that, while the droplet 100 shown in FIG. 1A is shown as one droplet structure, such a configuration is merely provided for illustrative purposes. The present disclosure may be configured to include one or more packed micelle structures in the droplet 100, including, but not limited to, wedge-like shape, corn-like shape, or cylinder-like shape. Additionally, the droplet 100 may include more than one droplets fused together.

As used throughout the present disclosure, the term "Non-Newtonian fluid" is used herein includes fluids that contain suspended particles or dissolved molecules. This term may include, but is not limited to, Bingham fluids, pseudoplastic fluids, dilatant fluids, thixotropic fluids, and viscoelastic fluids. The term shall include, but is not limited to, fluids whose characteristics are represented by the Ostwald-de Waele equation as follows:

$$\tau = K\left(\frac{dV}{dy}\right)^n$$

where K (often in $kg/ms^{2-n}$) and n (dimensionless) are constants determined by experimental fitting data. Generally, for pseudoplastic fluids, n is less than 1 and for dilatant fluids n is greater than 1.

As used throughout the present disclosure, the term "extensional viscosity (i.e., elongational viscosity)" is a measure of a fluid's ability to stretch under elongational stress. In other words, extensional viscosity is a viscosity coefficient when applied stress is extensional stress. It is noted that non-Newtonian fluids do not possess a direct correlation between extensional viscosity and shear rate and are capable of storing elastic energy under strain.

In embodiments, the droplet 100 includes extensional viscosity modifier to adjust viscosity coefficient of the droplet 100. The extensional viscosity modifier may reduce evaporation of the droplet 100 and increase droplet diffusion. For example, the extensional viscosity modifier may be formed from one or more polymers. For instance, the one or more polymers of the extensional viscosity modifier may include, but is not limited to, polyethylene oxide, hydroxylmethylcelulose, carboxylmethylcellulose, or the like. In some embodiments, the extensional viscosity modifier is non-Newtonian fluid.

In embodiments, the droplet 100 includes one or more viscosity modifiers to adjust viscosity of the droplet 100. For example, the viscosity modifier may be used to increase a dynamic viscosity of a liquid. For instance, the viscosity modifier may be used to increase the viscosity of the hydrophilic portion 102 of the droplet 100 and/or the hydrophobic portion 110 of the droplet 100.

In some embodiments, the viscosity modifier is formed from one or more polymers. For example, the one or more polymers of the viscosity modifier may include, but is not limited to, polyethylene oxide, hydroxylmethylcelulose, carboxylmethylcellulose, or combinations thereof. By way of another example, the viscosity modifier may include, but is not limited to, guar gum. In some embodiments, the viscosity modifier is formed from one or more copolymers. For example, the one or more copolymers of the viscosity modifier may include, but is not limited to, ethylene-propylene (EPM), ethylene-(C3-C18) alpha-olefin copolymers, ethylene-propylen-non-conjugated diene terpolymers (EDPM), or combinations thereof.

In embodiments, the droplet 100 may be sprayed using an apparatus described in U.S. Pat. No. 9,148,994 issued on Oct. 6, 2015, filed Nov. 12, 2012, by John Alvin Eastin, et al., titled SYSTEMS FOR THE CONTROL AND USE OF FLUIDS AND PARTICLES, which is incorporated herein by reference in its entirety.

Now referring to FIG. 1B, a plan view of a droplet including a micelle with an internal component is disclosed, in accordance with one or more embodiments of the present disclosure. It is noted herein that the embodiments and components described previously herein with respect to the droplet 100 should be interpreted to extend to the embodiments described in FIG. 1B.

In embodiments, a droplet 150 may include a hydrophilic portion 102 forming the most outer layer of the droplet 150, A hydrophobic portion 110 embedded inside the hydrophilic portion 102, an amphiphile 112 configured to form a hydrophilic head 106 connected to a hydrophobic tail 108, and an internal component 114 resting in the hydrophobic portion 110. In embodiments, the internal component 114 is fluid-dynamically located, meaning that a location of the internal component 114 may be dictated by its properties and the properties of the surrounding fluids. For example, the internal component 114 may be located substantially at the center of the hydrophobic portion 110 of the droplet 150.

In some embodiments, the internal component 114 of the droplet 150 may be a solid fuel particle capable of providing a combustible energy. For example, the solid fuel particle in the hydrophobic portion 110 may include, but is not limited to, coal dust, carbon black (e.g., pulverized fuel ash), hexamethylenetetramine, 1,3,5-trioxane, ammonium nitrate, ammonium perchlorate, potassium nitrate, or mixture thereof.

In some embodiments, the coal dust of the internal component 114 may be configured to have a particle size from a selected range. For example, the coal dust of the internal component 114 may have a particle size in the range of 10 μm to 1000 μm. For instance, the coal dust of the internal component 114 may have a particle size in the range of 38 μm to 850 μm.

In some embodiments, the coal dust of the internal component 114 may be configured to have a carbon composition percentage from a selected range. For example, the coal dust of the internal component 114 may have a carbon composition percentage in the range of 30% to 99%. For instance, the coal dust of the internal component 114 may have a carbon composition percentage in the range of 50% to 95%.

In some embodiments, the coal dust of the internal component 114 may be configured to have a hydrogen composition percentage from a selected range. For example, the coal dust of the internal component 114 may have a hydrogen composition percentage in the range of 1.0% to 10.0%. For instance, the coal dust of the internal component 114 may have a hydrogen composition percentage in the range of 2.0% to 7.0%.

In some embodiments, the coal dust of the internal component 114 may be configured to have an oxygen composition percentage from a selected range. For example, the coal dust of the internal component 114 may have an oxygen composition percentage in the range of 1.0% to 60%. For instance, the coal dust of the internal component 114 may have an oxygen composition percentage in the range of 2.0% to 40%.

It is noted that compositions and physical properties of coal may depend on mining sites of the coal and may change accordingly. Embodiments of the present disclosure may be configured to utilize a variety of coals from different coal mines to maintain the desired properties of the coal and to form the droplet 150 shown in FIG. 1B.

It is contemplated that, while the internal component 114 shown in FIG. 1B is represented as one site within the hydrophobic portion 102, such a configuration is merely provided for illustrative purposes. Embodiments of the present disclosure may be configured to include more than one sites for the internal component 114. It is further contemplated that, while the internal component 114 shown in FIG. 1B is substantially located at the center of the hydrophobic portion 110, such a configuration is merely provided for illustrative purposes. Embodiments of the present disclosure may be configured to adapt various locations for the internal component 114 in the hydrophobic portion 110.

It is contemplated that, while twelve amphiphiles 112 are shown in FIG. 1A, such a configuration is merely provided for illustrative purposes. Embodiments of the present disclosure may adapt any number of amphiphiles known in the art forming a stable micelle structure. It is further contemplated that, while one kind of amphiphile 112 is shown in FIG. 1A to form the micelle structure, such a configuration is merely provided for illustrative purposes. Embodiments of the present disclosure may be configured to include more than one kind of amphiphile to form the micelle structure.

It is noted that the internal component 114 shown in FIG. 1B may be soluble in the hydrophobic portion 110 and the solubilized internal component 114 may stay within the hydrophobic portion 110 of the droplet 150.

Figure 2A:
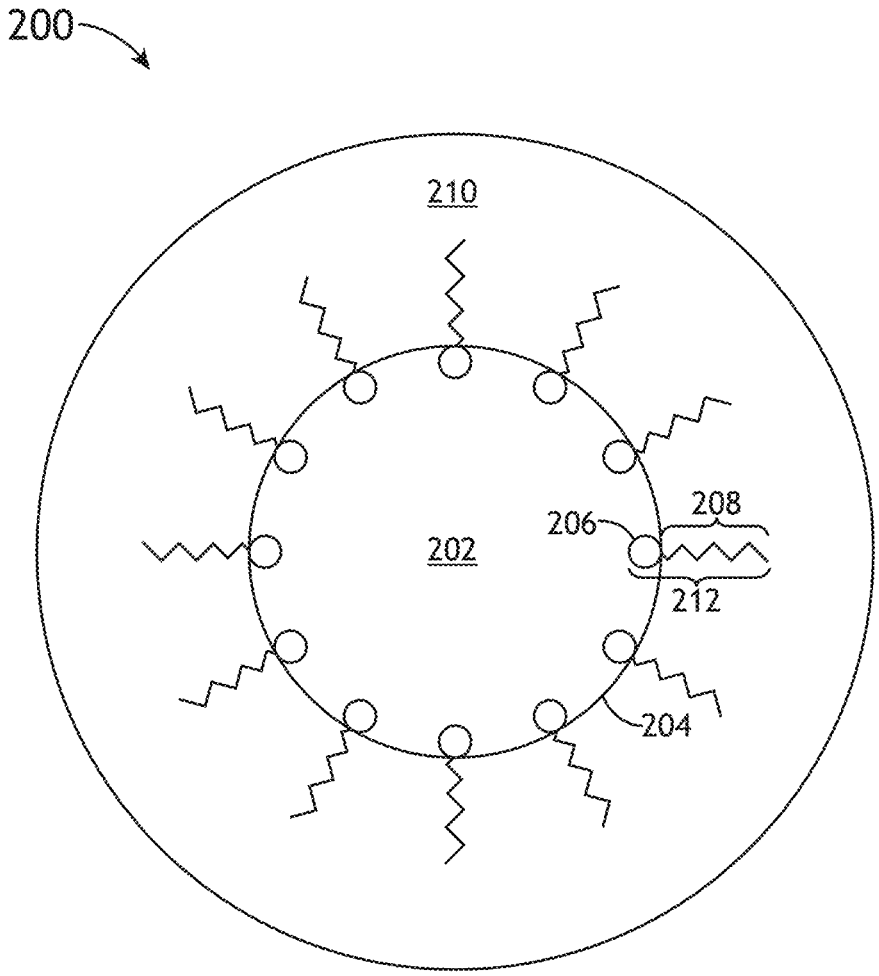
FIG. 2A illustrates a plan view of a droplet including a reverse micelle, in accordance with one or more embodiments of the present disclosure.

Now referring to FIG. 2A, a plan view of a droplet including a reverse micelle is disclosed, in accordance with one or more embodiments of the present disclosure. It is noted herein that the embodiments and components described previously herein with respect to the droplet 100 should be interpreted to extend to the embodiments described in FIG. 2A.

In embodiments, a droplet 200 represents a reverse micelle structure (i.e., inverse micelle or a water-in-oil system). The droplet 200 may include a hydrophobic portion 210 forming the most outer layer of the droplet 200. In some embodiments, the droplet 200 may include a hydrophilic portion 202 embedded inside the hydrophobic portion 210. In some embodiments, the droplet 200 may include an amphiphile 212 defining a layer 204 between the hydrophilic portion 202 and the hydrophobic portion 210. For example, the amphiphile 212 may be configured to form a hydrophilic head 206 connected to a hydrophobic tail 208. In this regard, the hydrophilic head 206 may be sequestered into the middle of the hydrophilic portion 202 and the hydrophobic tail 208 may extend away from the middle of the hydrophilic portion 202.

In general, the reverse micelle (a water in-oil system) such as shown in FIG. 2A is particularly of interest in an alternative fuel field. This is due to the ability of the reverse micelle reducing viscosities of alternative fuels sufficiently low so as that viscous alternative fuels do not lead to engine durability problems including injector coking, ring carbonization, and crankcase lubricant contamination.

It is noted that the difference between the droplet 100 shown in FIG. 1A and the droplet 200 shown in FIG. 2A is the ratio of the hydrophilic and the hydrophobic portions. When the ratio of the hydrophilic portion to the hydrophobic portion is greater than 1 to 1 (i.e., the hydrophilic portion is present more than the hydrophobic solute), the normal micelle in the droplet 100 may be a preferred droplet. On the other hand, when the ratio of the hydrophilic portion to the hydrophobic portion is less than 1 to 1 (i.e., the hydrophilic solute is present less than the hydrophobic portion), the reverse micelle in the droplet 200 may be a preferred droplet.

It is further noted that the reverse micelles are proportionally less likely to form on increasing hydrophilic head charge, since the hydrophilic sequestration of the hydrophilic head 206 creates highly unfavorable electrostatic interactions.

Figure 2B:
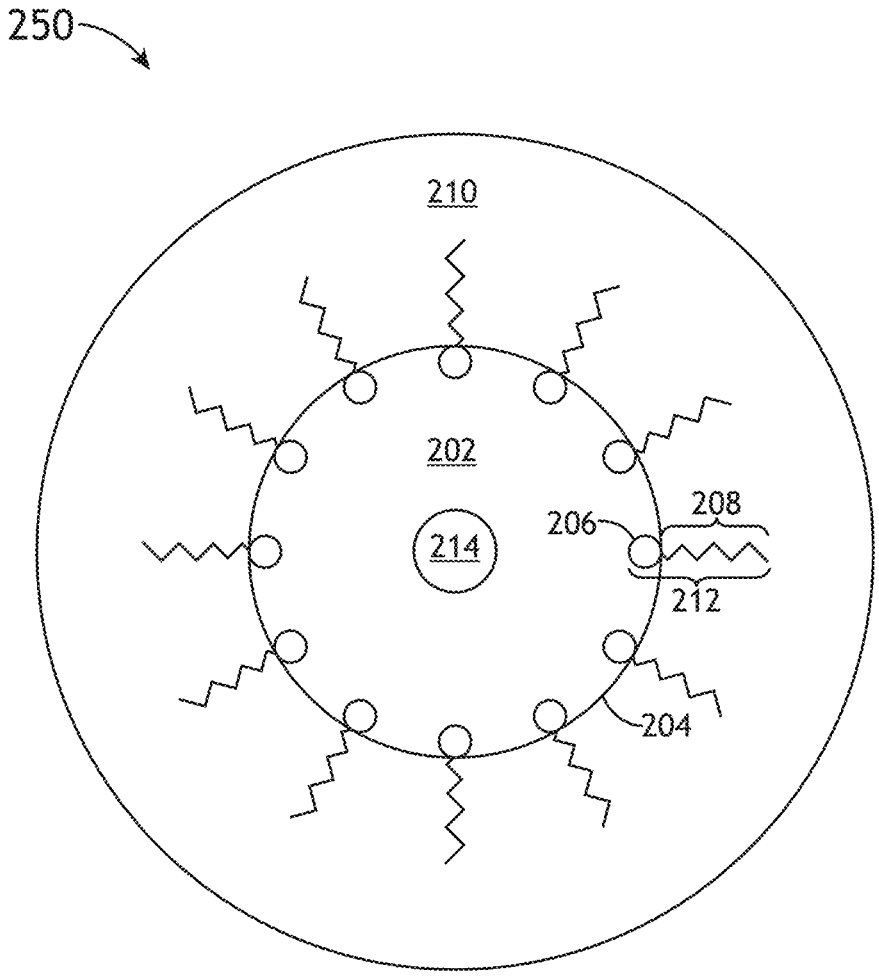
FIG. 2B illustrates a plan view of a droplet including a reverse micelle with an internal component, in accordance with one or more embodiments of the present disclosure.

Now referring to FIG. 2B, a plan view of a droplet including a reverse micelle with an internal component is disclosed, in accordance with one or more embodiments of the present disclosure. It is noted herein that the embodiments and components described previously herein with respect to the droplets 150 and 200 should be interpreted to extend to the embodiments described in FIG. 2B.

In embodiments, a droplet 250 may include a hydrophobic portion 210 forming the most outer layer of the droplet 250. In some embodiments, the droplet 150 may include a hydrophilic portion 202 embedded inside the hydrophobic portion 210. In some embodiments, the droplet 200 may include an amphiphile 212 defining a layer 204 between the hydrophilic portion 202 and the hydrophobic portion 210. For example, the amphiphile 212 may be configured to form a hydrophilic head 206 connected to a hydrophobic tail 208. In some embodiments, the droplet 250 may include an internal component 214 resting within the hydrophilic portion 202. For example, the internal component 214 may be located substantially at the center of the hydrophilic portion 202 of the droplet 250.

In some embodiments, the internal component 214 of the droplet 250 may be a liquid fuel capable of providing a combustible energy. For example, the liquid fuel in the hydrophilic portion 202 may include, but not limited to, a coal water slurry.

In some embodiments, the coal water slurry of the internal component 214 may be configured to have a viscosity from a selected range. For example, the coal water slurry of the internal component 114 may have a viscosity in the range of 100 centipoises to 1000 centipoise at 20° C. For instance, the coal water slurry of the internal component 114 may have a viscosity in the range of 500 centipoises to 750 centipoises at 20° C.

In some embodiments, the coal water slurry of the internal component 214 may be configured to have an ignition temperature from a selected range. For example, the coal water slurry of the internal component 114 may have an ignition temperature in the range of 700° C. to 900° C. For instance, the coal water slurry of the internal component 114 may have an ignition temperature in the range of 800° C. to 850° C.

In some embodiments, the coal water slurry of the internal component 214 may be configured to have a combustion temperature from a selected range. For example, the coal water slurry of the internal component 114 may have a combustion temperature in the range of 800° C. to 1300° C. For instance, the coal water slurry of the internal component 114 may have a combustion temperature in the range of 950° C. to 1150° C.

In some embodiments, the coal water slurry of the internal component 214 may be configured to have a coal content from a selected range. For example, the coal water slurry of the internal component 114 may have a coal content in the range of 50 wt % to 90 wt %. For instance, the coal water slurry of the internal component 114 may have a coal content in the range of 65 wt % to 75 wt %.

In some embodiments, the coal water slurry of the internal component 214 may be configured to have a water content from a selected range. For example, the coal water slurry of the internal component 114 may have a water content in the range of 10 wt % to 40 wt %. For instance, the coal water slurry of the internal component 114 may have a water content in the range of 20 wt % to 30 wt %.

In some embodiments, the coal water slurry of the internal component 214 may be configured to have a coal grain size from a selected range. For example, the coal water slurry of the internal component 114 may have a coal grain size in the range of 5 μm to 40 μm. For instance, the coal water slurry of the internal component 114 may have a coal grain size in the range of 10 μm to 20 μm.

It is contemplated that, while the internal component 214 shown in FIG. 2B is represented as one site, such a configuration is merely provided for illustrative purposes. Embodiments of the present disclosure may be configured to include more than one sites for the internal component 214 within the hydrophilic portion 202. It is further contemplated that, while the internal component 214 shown in FIG. 2B is substantially located at the center of the hydrophilic portion 202, such a configuration is merely provided for illustrative purposes. Embodiments of the present disclosure may be configured to adapt various locations for the internal component 214 within the hydrophilic portion 202.

It is noted that the internal component 214 shown in FIG. 2B may be soluble in the hydrophilic portion 202 and the solubilized internal component 214 may stay within the hydrophilic portion 202 of the droplet 250.

Figure 3:
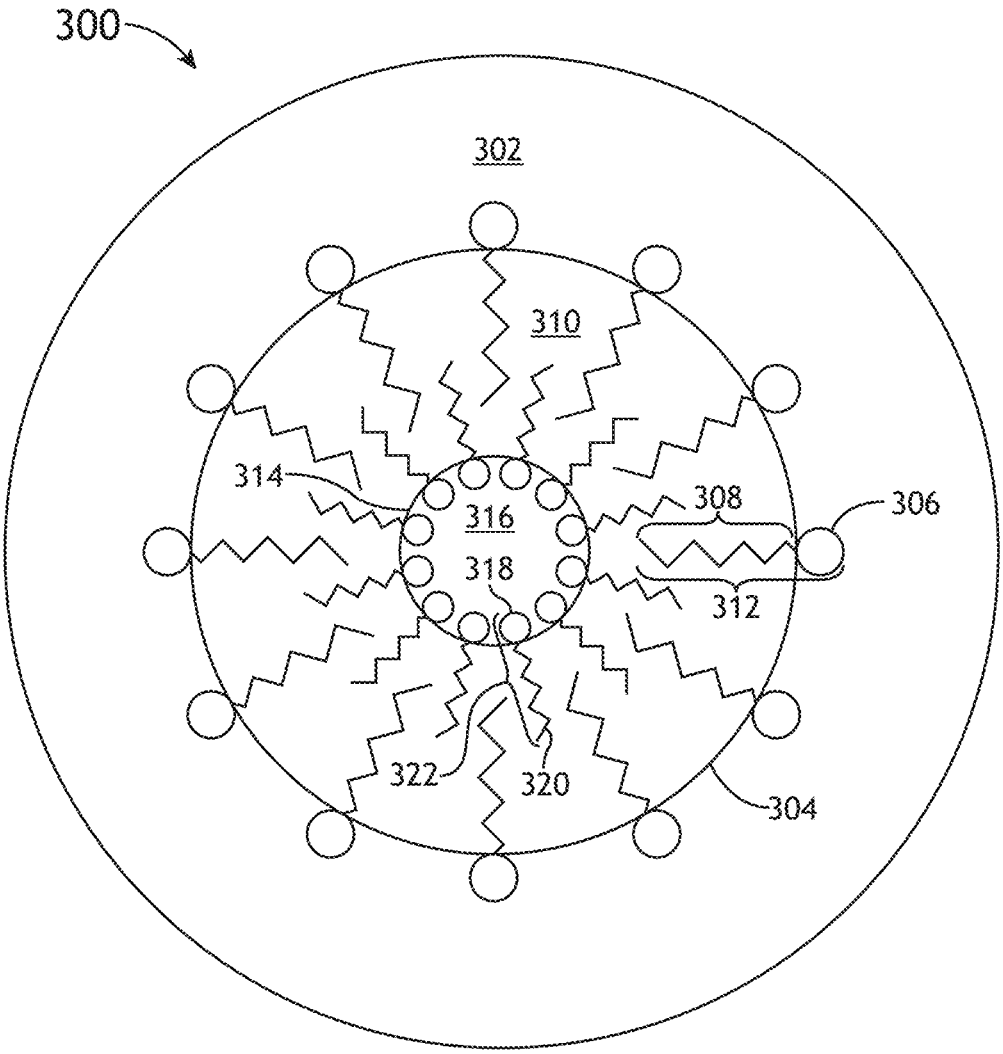
FIG. 3 illustrates a plan view of a droplet including a bilayer micelle, in accordance with one or more embodiments of the present disclosure.

Now referring to FIG. 3, a plan view of a droplet including a bilayer micelle is disclosed, in accordance with one or more embodiments of the present disclosure. It is noted herein that the embodiments and components described previously herein with respect to the droplets 100 and 200 should be interpreted to extend to the embodiments described in FIG. 3.

In embodiments, a droplet 300 may include a first hydrophilic portion 302 forming the most outer layer of the droplet 300. In some embodiments, the droplet 300 may include a hydrophobic portion 310 embedded inside the first hydrophilic portion 302. In some embodiments, the droplet 300 may include a first amphiphile 312 defining a layer 304 between the first hydrophilic portion 302 and the hydrophobic portion 310. For example, the amphiphile 312 may be configured to form a first hydrophilic head 306 connected to a first hydrophobic tail 308. For example, the first hydrophilic head 306 of the first amphiphile 312 may be in contact with the first hydrophilic portion 302. The first hydrophobic tail 308 of the first amphiphile 312 may extend away from the first hydrophilic portion 302 and rest within the hydrophobic portion 310.

In some embodiments, the droplet 300 may include a second amphiphile 322 defining a layer 314 between a second hydrophilic portion 316 and the hydrophobic portion 310. For example, the second amphiphile 322 may be configured to form a second hydrophilic head 318 connected to a second hydrophobic tail 320. For instance, the second hydrophilic head 318 of the second amphiphile 322 may be in contact with the second hydrophilic portion 316 located at the core of the droplet 300. The second hydrophobic tail 318 of the second amphiphile 322 may extend away from the second hydrophilic portion 316 and rest within the hydrophobic portion 310. In this regard, the second hydrophilic head 318 of the second amphiphile 322 may be sequestered into the middle of the second hydrophilic portion 316 and the second hydrophobic tail 320 of the second amphiphile 322 may extend away from the middle of the second hydrophilic portion 316.

In some embodiments, the droplet 300 may include a second hydrophilic portion 316. For example, the second hydrophilic portion 316 may be located at the core of the droplet 300. For instance, the second hydrophilic portion 316 located at the core of the droplet 300 may have different compositions than the first hydrophilic portion 302 covering the most outer layer of the droplet 300.

In some embodiments, the droplet 300 includes the first amphiphile 312 creating a layer 304 between the first hydrophilic portion 302 and the hydrophobic portion 310. In some embodiments, the droplet 300 includes the second amphiphile 322 creating a layer 314 between the second hydrophilic portion 316 and the hydrophobic portion 310. In this regard, the droplet 300 may form a bilayer micelle (i.e., liposome) equipped with two layers 304 and 314 formed with the amphiphiles 312 and 322, respectively.

The bilayer structure of the droplet 300 may be suitable for fuel field in that the second hydrophilic portion 316 of the droplet 300 may provide a further handle for forming smaller fuel droplets by vaporized hydrophilic portion 316 upon combustion. This increases surface area of the fuel droplets significantly and, in response, it facilitates more efficient fuel consumption with less unburned fuel residues left in engine chambers.

It is noted that, while the droplet 300 shown in FIG. 3 is depicted to include no internal components in the second hydrophilic portion 316, such a configuration is merely provided for illustrative purposes. Embodiments of the present disclosure may be configured to include the internal components in the hydrophilic portion 316 of the droplet 300 such as the solid fuel described above.

Figure 4A:
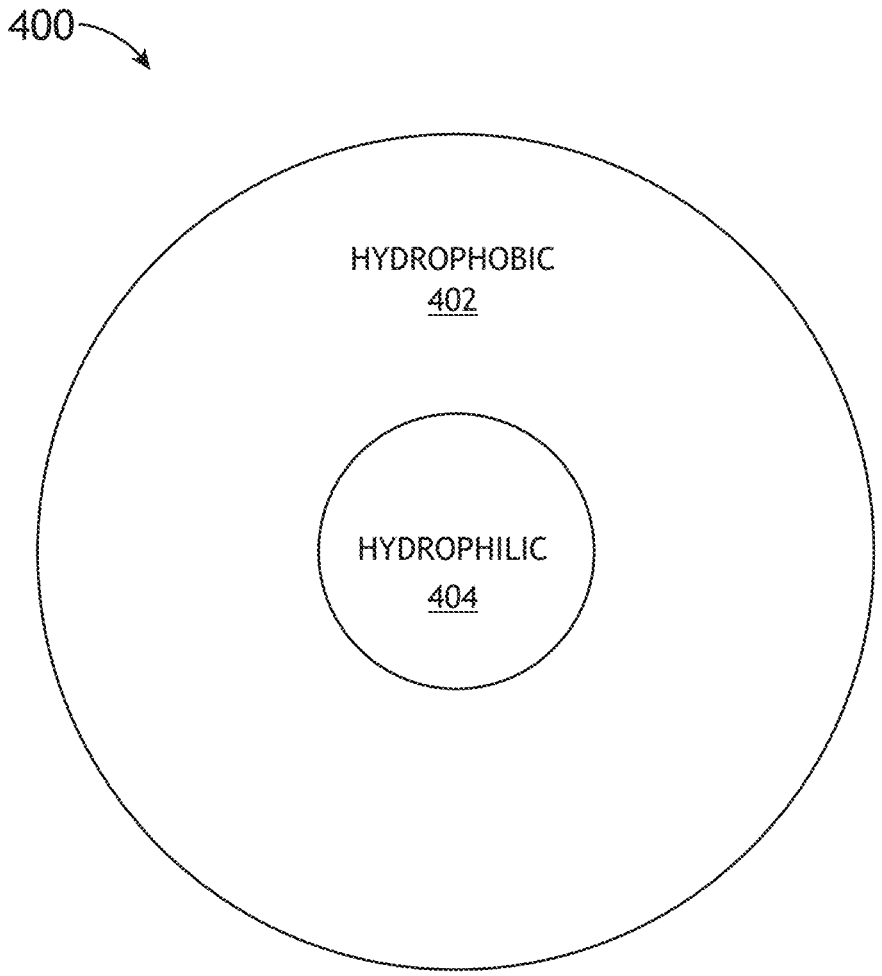
FIG. 4A illustrates a plan view of a droplet, in accordance with one or more embodiments of the present disclosure.
Figure 4B:
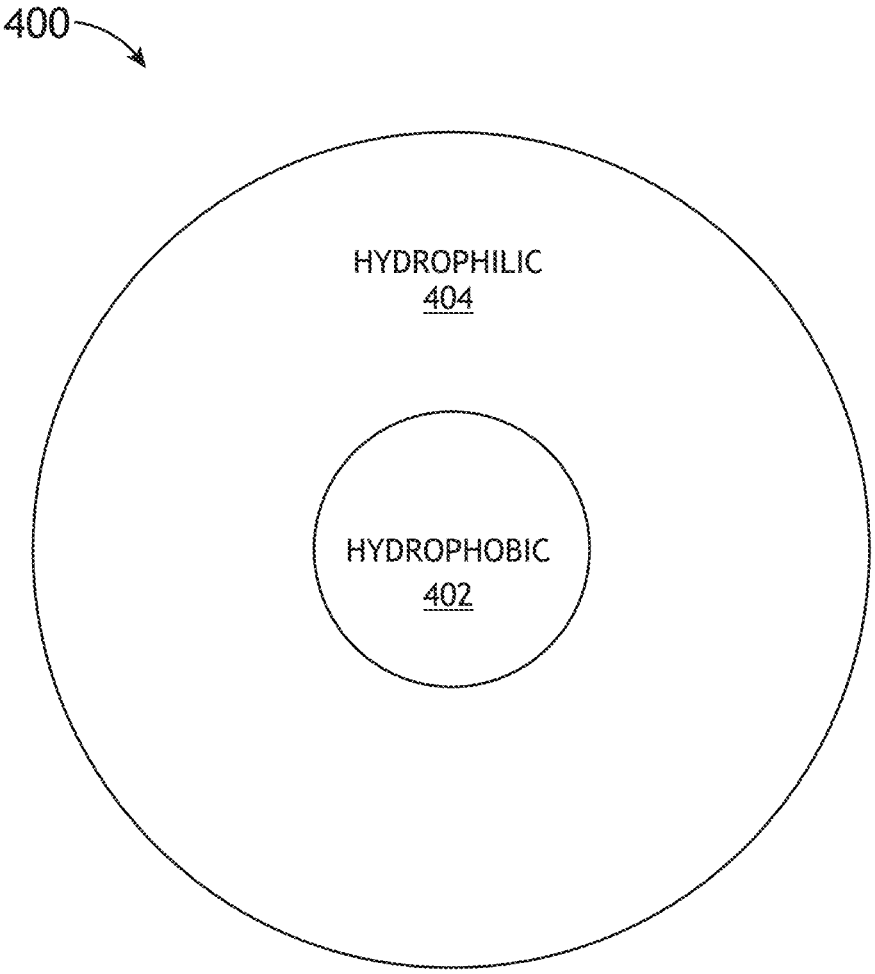
FIG. 4B illustrates a plan view of a droplet, in accordance with one or more embodiments of the present disclosure.

Now referring to FIGS. 4A-4B, a plan view of a droplet is disclosed, in accordance with one or more embodiments of the present disclosure. It is noted herein that the embodiments and components described previously herein with respect to the droplets 100, 150, 200, 250, and 300 should be interpreted to extend to the embodiments described in FIGS. 4A-4B.

In embodiments, a droplet 400 shown in FIG. 4A may include a hydrophobic portion 402 enclosing a hydrophilic portion 404 at the core of the droplet 400. It is noted that, while the hydrophilic portion 404 shown in FIG. 4A is located at the core of the droplet 400, such a configuration is merely provided for illustrative purposes. Embodiments of the present disclosure may be configured to adapt various hydrophilic portion locations within the hydrophobic portion 402.

It is further noted that, while the hydrophilic portion 404 shown in FIG. 4A is depicted as a droplet composition with one hydrophilic portion, such a configuration is merely provided for illustrative purposes. The present disclosure may be configured to adapt more than one hydrophilic portions within the hydrophobic portion 402 to provide necessary physical properties to the composition of droplet 400.

In embodiments, a droplet 450 shown in FIG. 4B may include a hydrophilic portion 404 enclosing a hydrophobic portion 402 at the core of the droplet 450. It is noted that, while the hydrophobic portion 404 shown in FIG. 4B is located at the core of the droplet 450, such a configuration is merely provided for illustrative purposes. Embodiments of the present disclosure may be configured to adapt various hydrophobic portion locations within the hydrophilic portion 404.

It is further noted that, while the hydrophobic portion 402 shown in FIG. 4B is depicted as a droplet composition with one hydrophobic portion, such a configuration is merely provided for illustrative purposes. The present disclosure may be configured to adapt more than one hydrophobic portions within the hydrophilic portion 404 to provide necessary physical properties to the composition of droplet 450.

It is noted that the droplets 400 and 450 may easily be formed by an apparatus described in U.S. Pat. No. 9,148,994.

Figure 5:
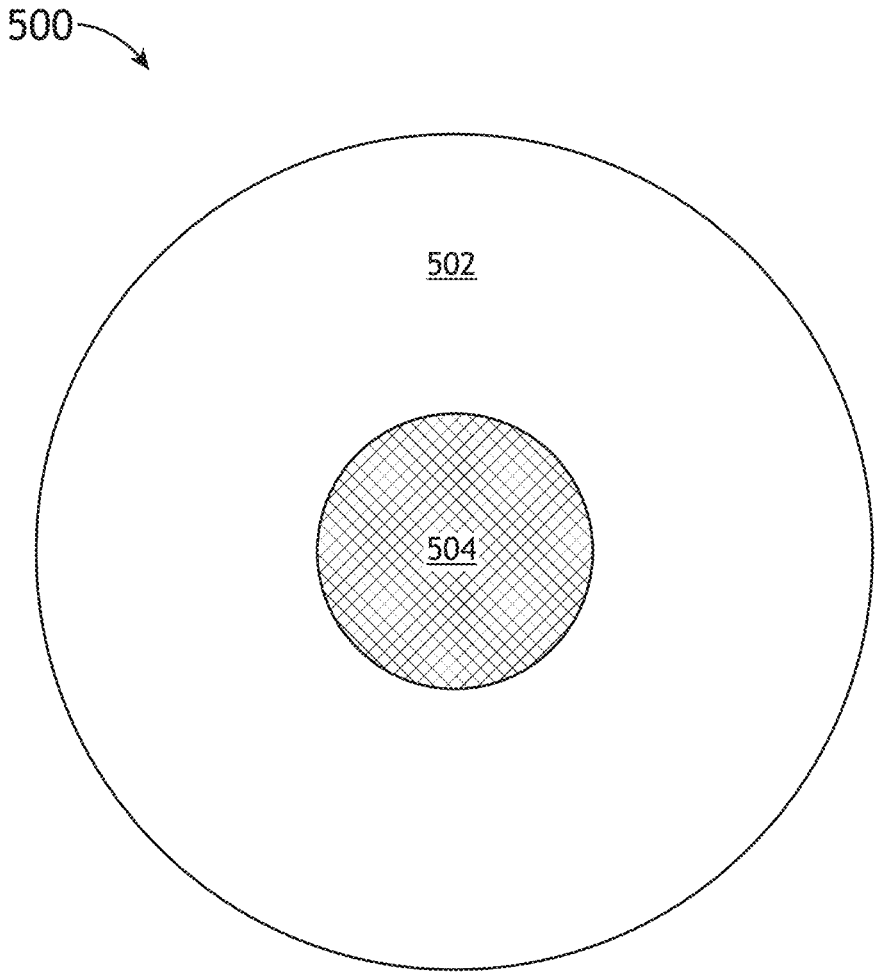
FIG. 5 illustrates a plan view of a droplet including an internal gas component, in accordance with one or more embodiments of the present disclosure.

Now referring to FIG. 5, a plan view of a droplet is disclosed, in accordance with one or more embodiments of the present disclosure. It is noted herein that the embodiments and components described previously herein with respect to the droplets 100, 150, 200, 250, 300, 400, and 450 should be interpreted to extend to the embodiments described in FIG. 5.

In embodiments, a droplet 500 may include a hydrophobic portion 502 enclosing an internal gas pocket 504. For example, the internal gas pocket 504 may include a gas capable of providing combustible energy to the droplet 500 including, but not limited to, oxygen, propane, butane, natural gas, hydrogen, acetylene, syngas, coal gas, biogas, or mixture thereof.

It is noted that, while the internal gas pocket 504 shown in FIG. 5 is located at the core of the droplet 500, such a configuration is merely provided for illustrative purposes. Embodiments of the present disclosure may be configured to adapt various internal gas pocket locations within the hydrophobic portion 502.

It is further noted that, while the internal gas pocket 504 shown in FIG. 5 is depicted as one internal gas pocket, such a configuration is merely provided for illustrative purposes. The present disclosure may be configured to adapt more than one internal gas pockets within the hydrophobic portion 502 to provide necessary physical properties to the composition of droplet 500.

Figure 6:
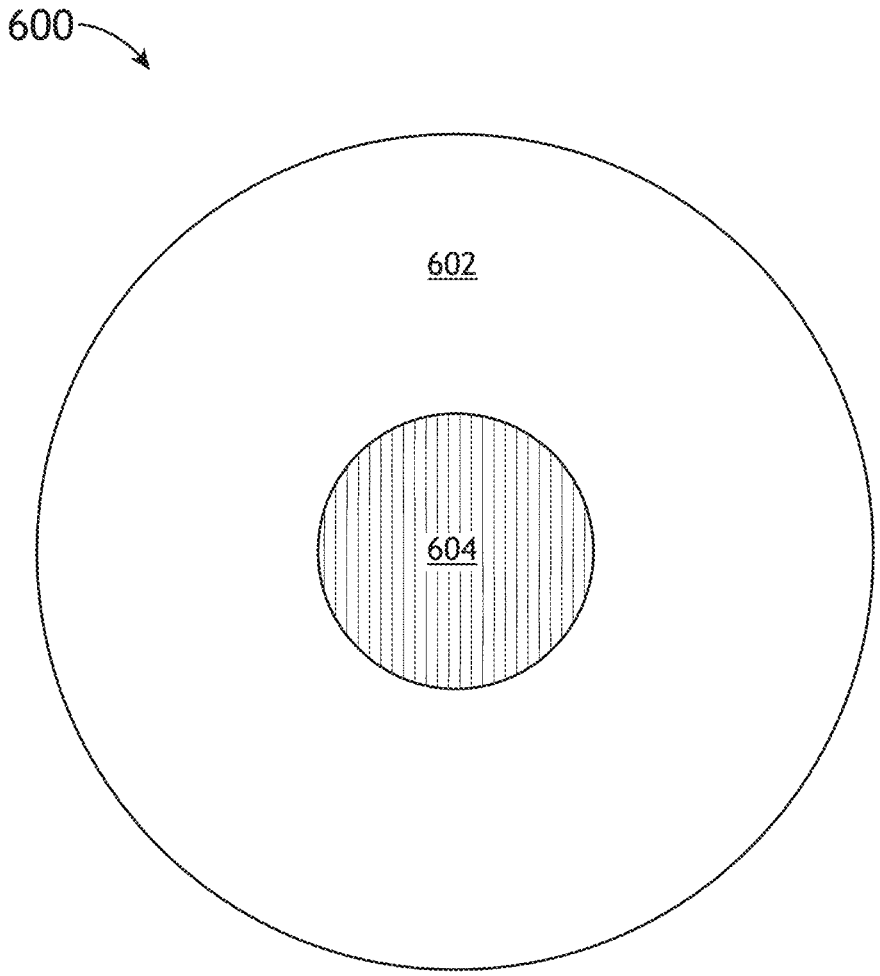
FIG. 6 illustrates a plan view of a droplet including an internal component, in accordance with one or more embodiments of the present disclosure.

Now referring to FIG. 6, a plan view of a droplet is disclosed, in accordance with one or more embodiments of the present disclosure. It is noted herein that the embodiments and components described previously herein with respect to the droplets 100, 150, 200, 250, 300, 400, 450, and 500 should be interpreted to extend to the embodiments described in FIG. 6.

In embodiments, a droplet 600 may include a hydrophobic portion 602 enclosing an internal component 604. For example, the internal component 604 may rest in the hydrophobic portion 602. For example, the internal component 604 may be located substantially at the center of the hydrophobic portion 602 of the droplet 600.

In some embodiments, the internal component 604 of the droplet 600 may be a solid fuel particle capable of providing a combustible energy. For example, the solid fuel particle in the hydrophobic portion 602 may include, but not limited to, a coal dust, hexamethylenetetramine, 1,3,5-trioxane, ammonium nitrate, ammonium perchlorate, potassium nitrate, or mixture thereof.

In some embodiments, the internal component 604 of the droplet 600 has a solid to viscous material (e.g., hydrophobic portion 602, gel, micelle, or combinations thereof) ratio of less than or equal to one parts in volume solid to three parts in volume viscous material.

It is noted that, while the internal component 604 shown in FIG. 6 is located at the core of the droplet 600, such a configuration is merely provided for illustrative purposes. Embodiments of the present disclosure may be configured to adapt various internal component locations within the hydrophobic portion 602.

It is further noted that, while the internal component 604 shown in FIG. 6 is depicted as one internal component, such a configuration is merely provided for illustrative purposes. The present disclosure may be configured to adapt more than one internal component within the hydrophobic portion 602 to provide necessary physical properties to the composition of droplet 600.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A droplet, comprising:

at least one of an extensional viscosity modifier and a viscosity modifier;

a hydrophilic portion;

a hydrophobic portion, wherein the droplet further comprises a colloid in at least one of a suspension and a dispersion forming a droplet nucleus, wherein the droplet nucleus is at least one of a one or more combustible solids or a one or more combustible gases.

2. The droplet of claim 1, wherein the droplet is generally spherical in free space and substantially between 20 and 500 microns in diameter.

3. The droplet of claim 1, wherein the at least one of an extensional viscosity modifier and a viscosity modifier is a polymer.

4. The droplet of claim 3, wherein the polymer is selected from the group essentially consisting of polyethylene oxide, hydroxylmethylcellulose, and carboxylmethylcellulose.

5. The droplet of claim 1, wherein the extensional viscosity modifier is non-Newtonian.

6. The droplet of claim 1, wherein the extensional viscosity modifier reduces evaporation and increases droplet diffusion.

7. The droplet of claim 1, wherein the viscosity modifier is guar gum.

8. The droplet of claim 1, wherein the hydrophilic portion is selected from the group consisting essentially of a water, ethanol, methanol, 2-propanol, t-butanol, glycerol, 1, 2-butanediol, 1, 3-butandiol, 1, 4-butandiol, 2-butoxyethanol, ethylene glycol, furfuryl alcohol, 1, 2-propanediol, 1, 3-propanediol, triethylene glycol, acetaldehyde, acetic acid, butyric acid formic acid, propanoic acid, diethanolamine, diethylenetriamine, dimethylformamide, ethylamine, methyl diethanolamine, triethylamine, 1, 4-dioxane, tetrahydrofuran, 1, 2-dimethylhydrazine, hydrazine, hydrofluoric acid, hydrogen peroxide, nitric acid, and sulfuric acid.

9. The droplet of claim 8, wherein the hydrophilic portion has a viscosity of between 0.040 to 1500 centipoise (mPa·s).

10. The droplet of claim 8, wherein the hydrophilic portion has a density of between 0.70 to 1.30 kg/l.

11. The droplet of claim 8, wherein the hydrophilic portion has an autoignition temperature of between 240 to 480° C.

12. The droplet of claim 8, wherein the hydrophilic portion has a flash point of between 10 to 200° C.

13. The droplet of claim 1, wherein the hydrophobic portion is selected from the group consisting essentially of gasolines, diesel fuels, kerosene, dimethyl ether, jet fuel, biodiesels, corn oil, canola oil, soybean oil, olive oil, sunflower oil, rapeseed oil, and peanut oil.

14. The droplet of claim 13, wherein the hydrophobic portion has a viscosity of between 0.4 to 12 centipoises (mPa·s).

15. The droplet of claim 13, wherein the hydrophobic portion has a density of between 0.70 to 0.90 kg/l.

16. The droplet of claim 13, wherein the hydrophobic portion has an autoignition temperature of between 150 to 400° C.

17. The droplet of claim 13, wherein the hydrophobic portion has a flash point of between −50 to 80° C.

18. The droplet of claim 1, wherein the one or more combustible solids are selected from the group consisting essentially of hexamethylenetetramine, 1,3,5-trioxane, ammonium nitrate, ammonium perchlorate, potassium nitrate, and coal dust.

19. The droplet of claim 1, wherein the one or more combustible gases are selected from the group consisting essentially of oxygen, propane, butane, natural gas, hydrogen, acetylene, syngas, coal gas, and biogas.

20. The droplet of claim 1, wherein a vapor pressure of the droplet is from a selected range, and wherein the selected range comprises from 0.01 atm to 8 atm at 10° C. to 170° C.

21. The droplet of claim 20, wherein the selected range is from 1.9 atm to 7.5 atm at 56° C. to 168° C.

* * * * *